US006182745B1

(12) United States Patent
Potier

(10) Patent No.: US 6,182,745 B1
(45) Date of Patent: Feb. 6, 2001

(54) HEAT EXCHANGER WITH PROTECTED THIN EDGES, ESPECIALLY FOR A MOTOR VEHICLE

(75) Inventor: Michel Potier, Rambouillet (FR)

(73) Assignee: Valeo Thermique Moteur, La Verriere (FR)

( * ) Notice: Under 35 U.S.C. 154(b), the term of this patent shall be extended for 0 days.

(21) Appl. No.: 09/261,053

(22) Filed: Mar. 2, 1999

(30) Foreign Application Priority Data

Mar. 3, 1998 (FR) ..... 98 02548

(51) Int. Cl.[7] ..... F28D 1/00; F28F 19/00
(52) U.S. Cl. ..... 165/149; 165/134.1
(58) Field of Search ..... 165/134.1, 149

(56) References Cited

U.S. PATENT DOCUMENTS

| | | | | |
|---|---|---|---|---|
| 3,165,151 | * | 1/1965 | Astrup et al. | 165/149 |
| 3,795,274 | | 3/1974 | Fieni | 165/122 |
| 4,465,126 | * | 8/1984 | Winterer | 165/149 |
| 4,484,621 | | 11/1984 | Kuchelmeister | 165/149 |
| 4,705,104 | * | 11/1987 | Potier | 165/149 |

FOREIGN PATENT DOCUMENTS

| | | | | |
|---|---|---|---|---|
| 24 18 132 | | 11/1975 | (DE) . | |
| 2418132 | * | 11/1975 | (DE) | 165/149 |
| 2 145 383 | | 2/1973 | (FR) . | |
| 2 371 6660 | | 6/1978 | (FR) . | |
| 2 522 401 | | 9/1983 | (FR) . | |
| 2 573 189 | | 5/1986 | (FR) . | |
| 2 585 462 | | 1/1987 | (FR) . | |
| 2 614 688 | | 11/1988 | (FR) . | |
| 2 745 075 | | 8/1997 | (FR) . | |
| 19605909 | * | 8/1997 | (FR) . | |
| 0072996 | * | 10/1957 | (JP) | 165/149 |
| 783925 | * | 10/1957 | (GB) | 165/149 |

OTHER PUBLICATIONS

French Search Report dated Nov. 4, 1998.

* cited by examiner

*Primary Examiner*—Ira S. Lazarus
*Assistant Examiner*—Tho Duong
(74) *Attorney, Agent, or Firm*—Morgan & Finnegan LLP

(57) ABSTRACT

A heat exchanger for an automobile radiator having a matrix of tubes extending through a stack of fins. The matrix has lateral faces having free edges of the fins which are protected by a side cover. The side cover comprises a spine portion and two side branches terminated in anchor hooks which engage with lateral notches on the fins. The spine portion is substantially flat and has on its internal face a longitudinal rib, which makes contact with the free edges of the fins.

10 Claims, 1 Drawing Sheet

HEAT EXCHANGER WITH PROTECTED THIN EDGES, ESPECIALLY FOR A MOTOR VEHICLE

FIELD OF THE INVENTION

This invention relates to heat exchangers, especially but not exclusively for motor vehicles. More particularly, it relates to a heat exchanger of the type comprising a matrix consisting of a bundle of tubes and a bundle of fins, or a bundle or stack of finned tubes, together with at least one lateral traverse member or side cover. This cover is made in the form of a profiled member of plastics material, with a U-shaped cross section.

The side cover is arranged to cover a side face of the matrix extending parallel to the tubes, and the U-shaped profiled element comprises a central spine portion joined to two side branches which are provided with anchor hooks, these anchor hooks being arranged to engage in lateral notches formed in the fins of the matrix.

BACKGROUND OF THE INVENTION

It is known, in particular from French patent specification No. 2 745 075, to provide a heat exchanger of the above type which comprises a packet or stack of fins made in the form of thin metallic leaves of rectangular form, which extend parallel to each other through which the tubes of the bundle pass. Each of the side faces, or minor faces, is protected by the lateral traverse member or side cover, which protects the free edges of the fins, these edges being particularly fragile. In this type of known heat exchanger, the spine portion of the side cover is deformable and has a concave form so as to take up clearance between the side cover and the matrix (having regard to the dimensional variations which are inherent in high quantity production).

Due to the concavity of the spine portion of the side cover, the two side branches of the latter have a natural tendency to spread apart from each other, which gives rise to a danger that the anchor hooks may become inadvertently disengaged from the notches in the fins of the matrix. In order to reduce this danger, it is necessary to make the anchor hooks, and the corresponding notches, with specific shapes which are similar to those of a fish hook or harpoon.

In addition, in the known heat exchangers of the above type, it frequently happens that at least one of the side covers includes a lateral wing portion, which may for example constitute a profiled sealing element for making sealing engagement against an appropriate item of equipment of the vehicle or against the structure of the vehicle itself. When this wing portion is subjected to a force, by engagement with such a part of the vehicle, it can increase the natural tendency of the side branches of the side cover to spread apart from each other, with consequent separation of the side cover from the matrix.

DISCUSSION OF THE INVENTION

A main object of the invention is to overcome the above mentioned drawbacks. In particular, it aims to provide a lateral traverse member or side cover which is able to take up clearances with the matrix as discussed above, but without any risk of separation of the side cover from the matrix.

A further object of the invention is to obtain such a side cover in which the side branches run no risk of being displaced away from each other, or spreading, and which also makes it unnecessary to give the notches in the sides of the fins, and the associated anchor hooks, any specific form or profile.

To this end, according to the invention, a heat exchanger comprising a matrix in the form of a bundle of tubes and fins, the heat exchanger including at least one lateral traverse member in the form of a profiled member of plastics material with a U-shaped cross section, the traverse member being adapted to cover a lateral face of the matrix, and the U-shaped profiled member comprising a spine portion joined to two side branches having anchor hooks adapted to engage in lateral notches of the said fins, is characterized in that the said spine portion of the traverse member is flat, and has an internal face facing towards the said fins, with a longitudinal rib on the said internal face adapted to make contact with the adjacent free edges of the fins.

This longitudinal rib (or, in more general terms, a projecting element or protuberance), ensures permanent contact between the edges of the fins and the traverse member, due to the inherent elasticity of the fins themselves. The lateral traverse members may also be referred to as side covers.

Due to the fact that the spine portion of the side cover is flat, there is no danger of the side branches spreading with respect to each other.

The longitudinal rib causes local deformation to take place in the fins of the matrix. This deformation is facilitated by the fact that the fins are in the form of thin metallic leaves. As a result, the rib penetrates into the free edges of the fins, so that the side cover is effectively caught on the matrix and thereby prevented from undergoing any longitudinal displacement under the effect of any mechanical applied forces, in particular when the side cover is in engagement on some other element external to the heat exchanger itself.

In a preferred embodiment of the invention, the longitudinal rib is continuous. It is preferably V-shaped in cross section in order to facilitate its penetration into the free edges of the fins of the matrix.

According to another preferred feature of the invention, the longitudinal rib lies in the center of the central spine portion of the traverse member, halfway between its two side branches.

Given that the side branches of the traverse member of the invention are in no danger of spreading apart, the lateral notches formed in the fins of the matrix can be made with a simple rectangular form. In addition, the anchor hooks do not have to have any specific form.

One of the branches of the traverse member may be attached to a lateral wing portion which may constitute a sealing profiled element, for engagement on an item of equipment of the vehicle or on the structure of the vehicle.

The or each lateral traverse member is preferably a profiled component formed by extrusion in plastics material.

The heat exchanger preferably includes two side covers covering two respective opposed side faces of the matrix.

Further features and advantages of the invention will appear more clearly on a reading of the following detailed description of some preferred embodiments of the invention, given by way of non-limiting example only and with reference to the accompanying drawings.

DESCRIPTION OF PREFERRED EMBODIMENTS OF THE INVENTION

Figure 1:
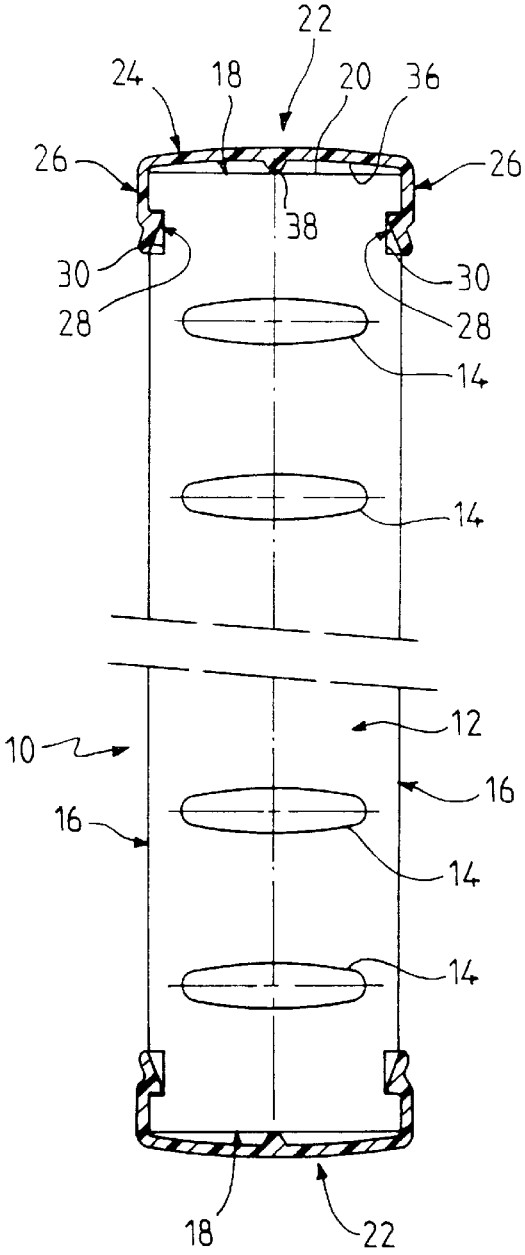
FIG. 1 is a view in transverse cross section showing part of a heat exchanger in accordance with the invention, having two lateral traverse members or side covers.

Reference is first made to FIG. 1. The heat exchanger here is, for example, a cooling radiator for the engine of a motor vehicle, and it comprises a matrix or bundle 10, which consists of a stack of fins 12 with a multiplicity of tubes 14 extending at right angles through the fins. The fins 12, or leaves, are of metal, for example aluminum, and are rectangular in shape, being disposed parallel to each other. The tubes 14 are also parallel to each other, and are joined to fluid headers (not shown) in the usual way at the ends of the tubes. The matrix consisting of the fins 12 and the tubes 14 together constitutes a bundle of generally rectangular form which is bounded by two longitudinal faces 16, referred to here as the major faces, and two side faces 18 referred to here as the minor faces.

Figure 2:
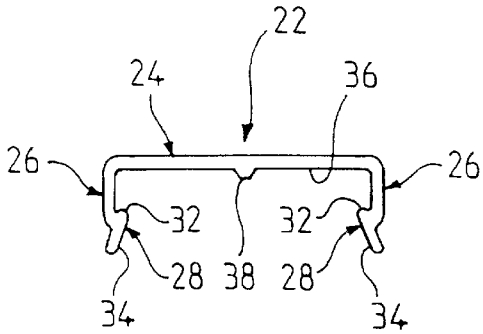
FIG. 2 is an end view of one of the side covers shown in FIG. 1.

Each of the side or minor faces 18 is defined by the free edges of the fins in the matrix. These free edges 20 may be plain, that is to say not turned back, or they may be hemmed, i.e. turned back by bending. In every case the free edges 20 are particularly fragile, and liable to be damaged during handling of the heat exchanger or even during its operation. In order to avoid such damage, each of the side faces 18 is protected by a lateral traverse member 22, or side cover, which covers the side face 18 and partially covers the longitudinal or a major faces 16 of the matrix. Each of the side covers 22 is made in the form of a U-shaped profiled component which comprises a central spine portion 24 of generally flat form, joined at right angles to two flat side branches 26 which are provided with respective anchor hooks 28 turned towards each other, as can be seen in FIGS. 1 and 2.

This U-shaped profiled component is made by extrusion in a flexible or semi-rigid plastics material such as polypropylene. The anchor hooks 28 consist of continuous ribs which are arranged to engage in lateral notches 30 formed in the edges of the fins of the matrix that correspond to the longitudinal faces 16 of the matrix. As can be seen in FIG. 2, the notches 30 are rectangular in form, and each of the hooks 28 has one side 32 which is joined at right angles to the corresponding side branch 26, together with an inclined side 34 joining the side 32 to the terminal edge of the hook.

The central spine portion 24 of the side cover has an inner face 36 facing towards the matrix, and a longitudinal rib 38 is formed on this internal face 36 and is arranged to come into contact with the free edges 20 of the fins 12 as shown in FIG. 1. This longitudinal rib 38 is here formed by extrusion and is therefore continuous in this example. In this example the rib 38 has a V-shaped profile and lies in the centre of the spine portion 24, halfway between the two side branches 26. The rib 38 enables clearance to be taken up having regard to the dimensional variations which are inherent in quantity production of the radiators.

The side covers 22 are attached to the matrix by simple snap-fitting over the respective minor faces 18 of the matrix. This causes the side branches 26 to be temporarily spread apart, but once the hooks 28 have penetrated into the notches 30, the branches 26 move towards each other again. Once this snap-fitting has taken place, the longitudinal rib 38 comes into engagement against the free edges 20 of the fins of the matrix, causing local deformation of the latter. This is true whether the edges 20 are plain or hemmed as mentioned above. This results in permanent contact between the fins and the side cover 22, thus preventing any accidental displacement of the side cover during mechanical operations to which the latter may be subjected.

Due to the fact that the longitudinal rib 38 comes into engagement against the free edges 20 of the fins, the spine portion 24 of the side cover will tend to assume a convex shape and to cause the two side branches 26 to move towards each other. It will be noted that this is contrary to the known solution discussed earlier herein. In the present case, this effect gives an improvement in the retention of the side cover 22.

Figure 3:
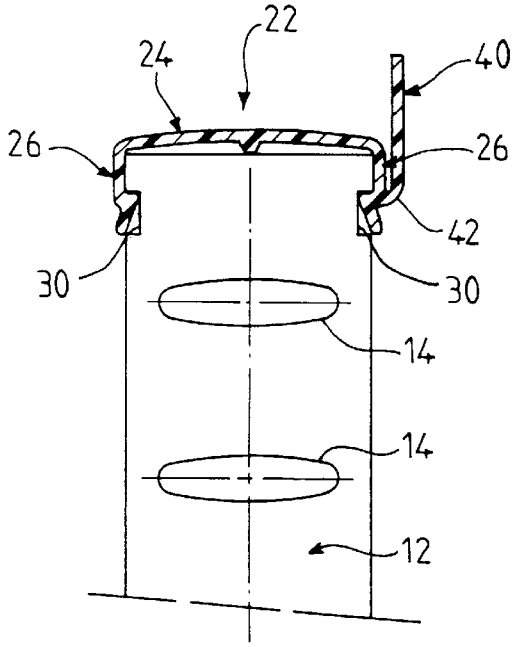
FIG. 3 is a view similar to FIG. 1, but shows part of a further embodiment of the side cover.

Reference is now made to FIG. 3 showing a modified embodiment. FIG. 3 shows a side cover 22 similar to the cover 22 in FIG. 1, except for the fact that it also includes a lateral wing portion 40 which extends parallel to one of the side branches 26 of the side cover 22. The lateral wing portion 40 is joined to the appropriate side branch 26 through a curved junction portion 42. The wing portion 40 extends the side cover, and constitutes a sealing or junction profile which is arranged to come into engagement against a selected item of equipment of the vehicle, or against part of the structure of the vehicle.

The invention is of course not limited to the embodiments described above by way of example, and does extend to other versions. For example the invention is not limited to one particular type of heat exchanger, nor to heat exchangers for motor vehicles.

What is claimed is:

1. A heat exchanger comprising a matrix having a multiplicity of fins positioned parallel to each other and a plurality of tubes extending through the fins, the fins together defining two side faces at opposite ends of the matrix, the fins having lateral notches formed therein, the heat exchanger further comprising at least one lateral traverse member having a U-shaped cross section and having a central spine portion, two side branches projecting from opposite sides of the spine portion, and an anchor hook at the end of each side branch, the anchor hooks being configured to engage with the lateral notches of the fins, whereby the at least one traverse member covers one of the side faces of the matrix, wherein the spine portion is substantially flat and has an internal face facing the matrix, and the spine portion further comprising a longitudinal rib on the internal face for abutting against the side face of the fins.

2. The heat exchanger according to claim 1, wherein the longitudinal rib is continuous.

3. The heat exchanger according to claim 1, wherein the longitudinal rib has a V-shaped profile.

4. The heat exchanger according to claim 1, wherein the longitudinal rib extends along the center of the spine portion, halfway between the two side branches.

5. The heat exchanger according to claim 1, wherein the notches in the fins are rectangular.

6. The heat exchanger according to claim 1, wherein the side cover further comprises a lateral wing portion attached to one of the side branches.

7. The heat exchanger according to claim 1, wherein each traverse member is an extruded profiled component of plastic material.

8. The heat exchanger according to claim 1 comprising two lateral traverse members, each covering one of the two side faces of the matrix.

9. The heat exchanger according to claim 1, wherein the at least one lateral traverse member comprises plastic material.

10. A heat exchanger comprising:

a matrix of a plurality of parallel fins having a plurality of tubes extending therethrough, the matrix having two ends, and a front face and a back face, the parallel fins having notches at the front face and the back face of the matrix;

an U-shaped side cover for covering and protecting the two ends of the matrix, the side cover having a hook at each end of the side cover for mating with the two notches, the side cover having a longitudinal rib at its internal face for abutting against the ends of the matrix.

* * * * *